United States Patent [19]

Rolfs

[11] Patent Number: 4,463,324

[45] Date of Patent: Jul. 31, 1984

[54] MINIATURE COAXIAL LINE TO WAVEGUIDE TRANSITION

[75] Inventor: John C. Rolfs, Clearwater, Fla.

[73] Assignee: Sperry Corporation, New York, N.Y.

[21] Appl. No.: 384,828

[22] Filed: Jun. 3, 1982

[51] Int. Cl.[3] ..... H01P 5/103

[52] U.S. Cl. ..... 333/26; 333/33

[58] Field of Search ..... 333/26, 21 R, 33

[56] References Cited

U.S. PATENT DOCUMENTS 3,605,041 9/1971 Judkins ..... 333/21 R X 4,349,790 9/1982 Landry ..... 333/26

*Primary Examiner*—Paul L. Gensler

*Assistant Examiner*—Benny Lee

*Attorney, Agent, or Firm*—Howard P. Terry; Ralph A. Johnston

[57] ABSTRACT

A miniature coaxial transmission line to waveguide transition particularly useful for frequencies beyond 40 GHz utilizes a projecting center conductor of a miniature coaxial line inserted directly into a waveguide. A metallic cylindrical sleeve is affixed to the end of the projecting center conductor to form a probe. The coaxial line is housed in the waveguide flange, and a plate is affixed across the cross section of the waveguide to provide a short circuit.

6 Claims, 1 Drawing Figure

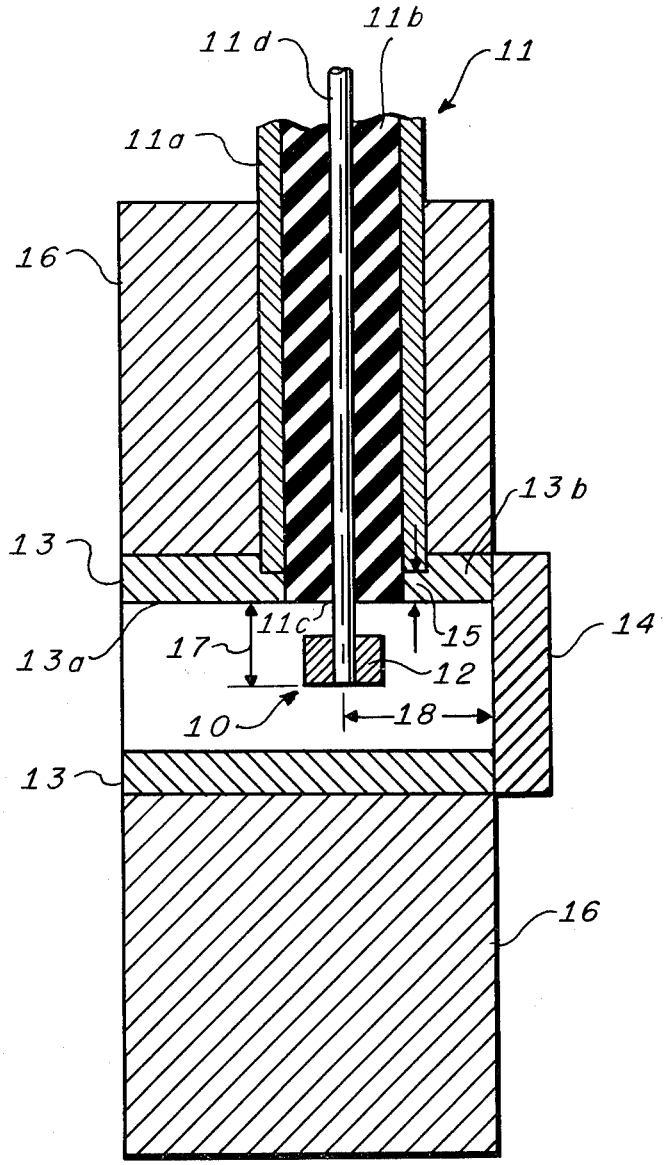
11d
11b
11
11a
16
13b
13
11c
15
14
13a
17
12
10
18
13
16

MINIATURE COAXIAL LINE TO WAVEGUIDE TRANSITION

BACKGROUND OF THE INVENTION

1. Field of the Invention

The invention relates generally to microwave transmission line transitions, and more particularly to transitions from miniature coaxial lines to waveguides.

2. Description of the Prior Art

A transition from a rectangular waveguide to a coaxial line converts the dominant $TE_{10}$ mode in the waveguide to the TEM mode in the coaxial line. Waveguide to coaxial transitions have been widely used since the early days of microwave technology.

The coupling mechanism may be either a probe parallel to the electric field or a loop normal to the magnetic field; the more successful version has been the electric probe.

For frequencies up to 40 GHz, special miniature coaxial connectors have been designed that eliminate the propagation of higher order modes. However, for frequencies above 40 GHz, the use of mating coaxial connectors is impractical, due to the difficulty of designing connectors that prevent the generation of higher order modes, and mating defects resulting from very slight dimensional changes due to wear caused by disassembly and assembly.

Thus, there is a need for a transition that is useful for frequencies beyond 40 GHz.

SUMMARY OF THE INVENTION

An object of the invention is to provide a practical transition from a miniature coaxial line to a waveguide for frequencies above 40 GHz. This is accomplished by the elimination of mating connectors.

In a preferred embodiment of the invention the projecting center conductor of a miniature coaxial line is inserted directly into a rectangular waveguide through the waveguide connecting flange. A cylindrical sleeve is affixed to the end of the center conductor to form a probe. Contact between the coaxial line outer conductor and the flange housing decreases energy loss and improves mechanical stability. With this arrangement the coaxial line may be coiled through relatively small radii without significant increase in VSWR at the transition. Relatively large lengths of coaxial line may be coiled to form a compact assembly with small displacements between transitions.

In this fashion, the invention overcomes the fundamental high frequency restriction of standard connectors, providing a low cost technique for realizing a high performance coaxial to waveguide transition. The invention allows the full fundamental mode capability of the coaxial line to be utilized; the only high frequency limit of the invention is the capability of the coaxial line to support only the TEM mode. When the coaxial line is coiled, the invention finds confined space applications in delay lines, millimeter wave RF front ends, and antenna feed assemblies.

BRIEF DESCRIPTION OF THE DRAWING

The sole FIGURE is a cross sectional view of the preferred embodiment of the invention.

DESCRIPTION OF THE PREFERRED EMBODIMENTS

Referring to the sole FIGURE, in the preferred embodiment of the invention miniature coaxial line 11, which may be of the type known in the art as UT-85, is stripped at one end of outer conductor 11*a* and dielectric 11*b* to establish end surface 11*c* that is substantially perpendicular to the axis of coaxial line 11, and to establish a projection of center conductor 11*d*. Cylindrical sleeve 12 is positioned in electrical contact on the end of the projecting center conductor 11*d* to form probe 10. Preferably, cylindrical sleeve 12 comprises copper. Positioning may be achieved by soldering cylindrical sleeve 12 to the end of projecting center conductor 11*d*. Cylindrical sleeve 12 is utilized as a means for broadening the bandwidth of the transistion and lowering reflection. Waveguide coupling flange 16 is affixed to waveguide 13. Flange 16 may be of the type known in the art as UG599/U. Flange 16 and wave-guide 13 may be brazed together. An aperture is drilled in flange 16 and waveguide 13, through which coaxial line 11 is inserted. Probe 10 is inserted directly into waveguide 13. Waveguide 13 is preferably rectangular, and may be of the type known in the art as WR-22. Probe 10 is disposed so that its axis is substantially normal to the surface of waveguide 13 surrounding coaxial line 11. Preferably, end surface 11*c* of coaxial line 11 is flush with inner surface 13*a* of waveguide 13. A further section of outer conductor 11*a* may be stripped from coaxial line 11, in order to seat coaxial line 11 a distance 15 against waveguide wall 13*b*, so that probe 10 extends a predetermined distance into waveguide 13. Shorting plate 14 is attached across the cross section of waveguide 13 that is substantially normal to the central axis of waveguide 13, at a predetermined distance 18 from probe 10. Coaxial line 11 is soldered to flange 16. Coaxial line 11 may be positioned against flange 16 by any means which provides good electrical contact between outer conductor 11*a* and flange 16. Probe depth 17, and probe distance 18 from shorting plate 14 are chosen to minimize leakage and reflection losses at the design frequency.

In practice, for frequencies in the 40–50 GHz range, the following dimensions, with a tolerance of ±0.002 inches, were employed:

Diameter of cylindrical sleeve 12=0.043 inches
Length of cylindrical sleeve 12=0.039 inches
Probe depth 17=0.050 inches
Shorting plate distance 18=0.050 inches
Seating distance 15=0.020 inches The transmission of microwave energy is bilateral between the coaxial line and the waveguide. Energy from the coaxial line in the TEM mode is launched into the waveguide. Proper selection of the probe depth, and the probe distance from the short circuit minimize loss and reflection. The energy becomes a traveling wave in the $TE_{10}$ mode in the waveguide and can be passed into a transmission line connected to the waveguide flange. Conversely, a traveling wave entering the waveguide is launched into the coaxial line by the same mechanism.

The coaxial line may be coiled without significant increase of loss or VSWR. This permits relatively large lengths of coaxial line to be accommodated in a compact assembly with small displacements between transitions. In practice, an inside coil diameter of one-fourth of an inch was used without loss of electrical performance. A coiled length of 12 inches was obtained with a linear length of one and one-fourth inches between transitions.

While the invention has been described in its preferred embodiments it is to be understood that the words which have been used are words of description rather than limitation and that changes may be made within the purview of the appended claims without departing from the true scope and spirit of the invention in its broader aspects.

We claim:

1. A miniature coaxial line to waveguide transition for frequencies beyond 40 GHz operable over a bandwidth having a center frequency therein, comprising:

(a) a waveguide having a first end, a second end, a central axis, a wall, an inner surface, and an aperture in said wall;

(b) a waveguide coupling flange, having an aperture therein and a coupling end, affixed to said waveguide so that said coupling end is adjacent to said first end and so that said aperture in said flange is aligned with said aperture in said wall of said waveguide;

(c) a miniature coaxial line, having an outer conductor, a dielectric, and a center conductor projecting from one end, disposed in said aperture in said flange so that said outer conductor is in electrical contact with said flange and so that said projecting center conductor extends continuously through said aperture in said wall into said waveguide substantially perpendicular to said inner surface of said waveguide at said aperture in said wall; and (d) a shorting plate, disposed at said second end of said waveguide substantially perpendicular to said central axis of said waveguide such that said projecting center conductor extends into said waveguide between said plate and said coupling end of said waveguide coupling flange.

2. Apparatus as in claim 1 further comprising means, positioned on said projecting center conductor, for broadening said bandwidth of said transition about said center frequency.

3. Apparatus as in claim 2 wherein said broadening bandwidth means comprises a metallic cylindrical sleeve.

4. Apparatus as in claim 1, 2 or 3 wherein said dielectric is in substantial alignment with said inner surface of said waveguide surrounding said aperture.

5. Apparatus as in claim 4 wherein said waveguide comprises a rectangular waveguide.

6. Apparatus as in claim 5 further comprising solder means for positioning said outer conductor in electrical contact with said flange.

* * * * *